United States Patent [19]

Biggs et al.

[11] Patent Number: 4,567,701

[45] Date of Patent: Feb. 4, 1986

[54] PREFABRICATED PANEL FOR A POST AND SILL PANELIZED LOG WALL SYSTEM

[75] Inventors: Stephen R. Biggs, Petoskey; Robert A. Brown, Jr., Gaylord; Julius Kowalski, Boyne Falls, all of Mich.

[73] Assignee: Town and Country Log Homes Co., St. Louis, Mo.

[21] Appl. No.: 692,175

[22] Filed: Jan. 17, 1985

[51] Int. Cl.[4] ..... E04B 1/10

[52] U.S. Cl. ..... 52/233; 52/235

[58] Field of Search ..... 52/233, 235

[56] References Cited

U.S. PATENT DOCUMENTS 4,115,969 9/1978 Napier ..... 52/233

4,154,036 5/1979 Moss et al. ..... 52/233

FOREIGN PATENT DOCUMENTS 1484520 5/1967 France ..... 52/235

*Primary Examiner*—Henry E. Raduazo

*Assistant Examiner*—John M. White

*Attorney, Agent, or Firm*—Senniger, Powers, Leavitt and Roedel

[57] ABSTRACT

A prefabricated panel for a post and sill panelized log wall system comprises vertical mullions having generally parallel first and second side faces and inside and outside faces. Each mullion has a first and second grooves extending lengthwise thereof in the first side face and a third groove extending lengthwise thereof in the second side face. Each mullion further has a recess at its lower end extending up from its lower end and extending toward the outside from its inside face providing a vertical face facing toward the inside and an upper shoulder extending from its inside face. A rigid insulation panel extends between the mullions having its ends sealed and adhered in the first grooves, the insulation panel extending from the top of the prefabricated panel down to and terminating at the level of the shoulders. A layer of nail plugging material is provided on the outside of the insulation panel between the first side faces of the mullions and a series of wood log slabs is provided on the outside of the layer of material extending between the first side faces of the mullions. A series of tongue and grooved elongate wood panel members is provided on the inside of the insulation panel extending between the first side faces of the mullions.

3 Claims, 5 Drawing Figures

PREFABRICATED PANEL FOR A POST AND SILL PANELIZED LOG WALL SYSTEM

BACKGROUND OF THE INVENTION

This invention relates generally to log homes and, more particularly to a prefabricated panel for a post and sill panelized log wall system.

SUMMARY OF THE INVENTION

Among the several objects of the invention may be noted the provision of a prefabricated panel with improved means for mounting the panel in place; and the provision of such a panel which is simple, sturdy and economical in construction.

Generally, a prefabricated panel for a post and sill panelized log wall system of this invention comprises vertical mullions constituting the side of the panel, each mullion comprising a wooden member of generally rectangular cross section having generally parallel first and second side faces and inside and outside faces. The first side faces of the mullions are positioned so as to face each other. Each mullion has a first groove extending lengthwise thereof in the first side face, a second groove extending lengthwise thereof in the first side face between the first groove and the inside face of the panel, and a third groove extending lengthwise thereof in the second side face thereof. Each mullion has a recess at its lower end extending up from its lower end and extending toward the outside from its inside face providing a vertical face facing toward the inside and an upper shoulder extending from its inside face to the vertical face. The vertical face is generally coplanar with the edges of the first grooves toward the outside of the mullions. A rigid insulation panel extends between the mullions having its ends sealed and adhered in the first grooves. The insulation panel extends from the top of the prefabricated panel down to and terminating at the level of the shoulders. A layer of nail hole plugging material is provided on the outside of the insulation panel between the first side faces of the mullions, and a series of wood log slabs, one above another, is provided on the outside of the layer of material extending between the first side faces of the mullions. A series of elongate wood panel members, one above another, is provided on the inside of the insulation panel, extending between the first side faces of the mullions. The wood panel members are tongue and grooved top and bottom. The wood panel members also have vertically extending grooves in their ends. Wood splines extend in the second grooves of the mullions and the grooves in the ends of the wood inside panel members with sealing material therefor. The bottom edges of the lowermost wood panel is generally flush with the shoulders.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
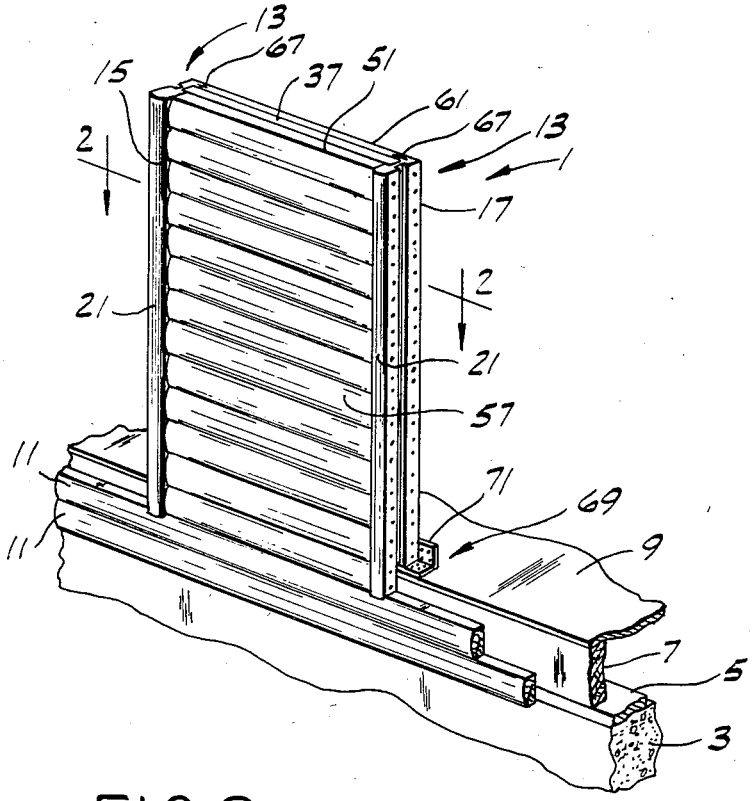
FIG. 1 is a perspective view of a prefabricated panel for a post and sill panelized log wall system of this invention.

Referring now to the drawings, a prefabricated panel for a post and sill panelized log wall system of this invention is designated generally by the reference numeral 1. It is shown mounted on a conventional foundation 3 for a house having a sill plate 5 secured to the top of the foundation with the boxing 7 and a subfloor 9 thereabove. Elongate log slabs 11 are secured along the boxing and foundation below the panel 1 as shown.

Figure 2:
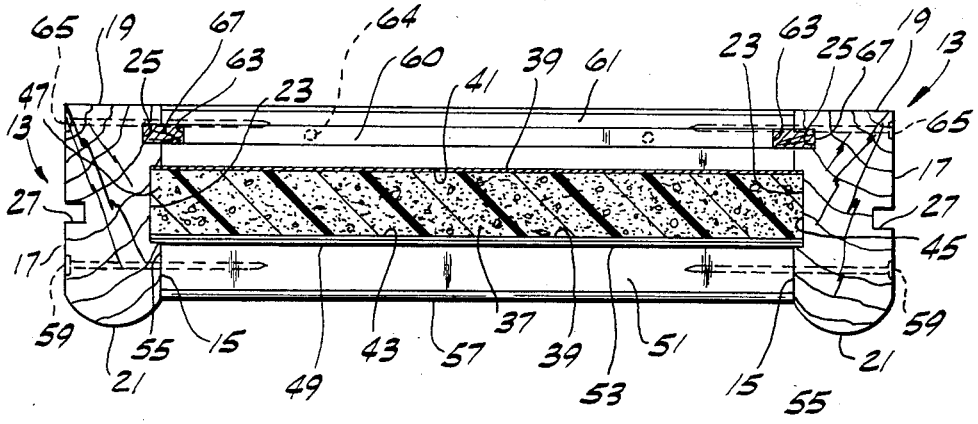
FIG. 2 is an enlarged horizontal section on line 2—2 of FIG. 1.
Figure 3:
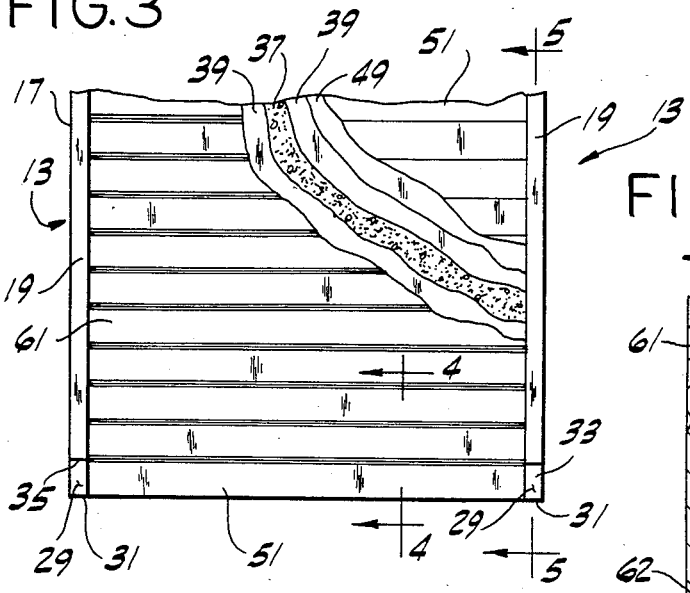
FIG. 3 is an enlarged rear view of the panel of FIG. 1 with parts broken away to show details.
Figure 4:
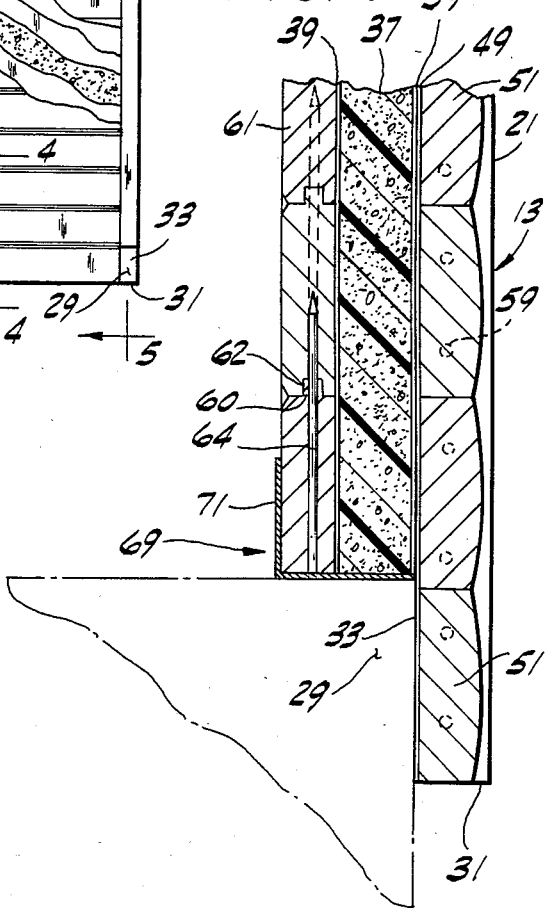
FIG. 4 an enlarged vertical section on line 4—4 of FIG. 3.
Figure 5:
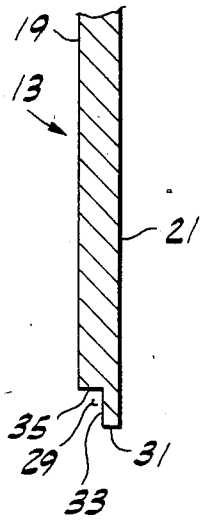
FIG. 5 is an enlarged vertical section on line 5—5 of FIG. 3.

More particularly, the panel 1 comprises a pair of vertical mullions 13 constituting the sides of the panel. Each mullion comprises a wooden member, preferably cedar wood, of generally rectangular cross section having generally parallel first and second side faces 15 and 17, respectively, and inside and outside faces 19 and 21, respectively. As shown in FIG. 2, the first side faces 15 of the mullions 13 are designed to face each other. Each mullion has a first groove 23 extending lengthwise thereof in side face 15 and generally centrally thereof. Each mullion also has a second groove 25 extending lengthwise thereof in side face 15 between the first groove 23 and the inside face 19 of the mullion. A third groove 27 extends lengthwise in the second side face 17 of each mullion and generally centrally thereof. Grooves 25 and 27 are generally of the same dimensions and, as shown, are generally not as wide as groove 23. As shown in FIGS. 3, 4, and 5 each mullion further has a recess 29 at its lower end 31 extending up from its lower end and extending toward the outside from its inside face 15. The recess 29 provides a vertical face 33 facing toward the inside and an upper shoulder 35 extending from its inside face to the vertical face. The vertical face 33 is generally coplanar with the edges of the first grooves 23 toward the outside of the mullion 13.

A rigid insulation panel or board 37 extends between the mullions as shown in FIG. 2. Panel 37 is generally rectangular in cross section and has a layer of foil 39 on both its inside and outside faces 41 and 43, respectively. The ends 45 and 47 of the panel are sealed and adhered in the first grooves 23 of each mullion. The insulation panel extends from the top of the mullions of the prefabricated panel down to and terminates at the level of the shoulders 35 of the mullions. The panel 37 not only serves as a means of insulation for an energy efficient log wall system high in R-value with no infiltration of outside air but also aids in the structural integrity of each panel.

A layer of nail hole plugging material such as felt 49 is secured to the layer of foil 39 over the outside face 43 of the insulation panel and between side faces 15 of the mullions. The layer of felt is designed to prevent the seepage of water through the panel from the outside and 15# weight felt is preferred.

A series of wood log slabs 51, one above another, is secured on the outside of the layer of felt 49 and extend between side faces 15 of the mullions. The slabs are made of cedar wood having generally flat inside and end faces 53 and 55, respectively, and a somewhat rounded outside face 57. As best seen in FIG. 4, the outside faces of the slabs do not extend outwardly as far as the outside face of the mullions. The slabs are secured in place by 30d galvanized nails 59 driven through each mullion from its second side face 17 and into the slab through its end 55. Generally, two nails in each end of the slab are all that is needed to secure the slab in place. It will be understood that the top of the uppermost slab and the bottom of the lowermost slab should be generally flush with the top and bottom of the mullions, respectively.

A series of tongue and grooved elongate wood panel members 61, one above another, is secured on the inside of the insulation panel 37 and extends between the first side faces 15 of the mullions. The members 61 are generally rectangular in cross section and are made of either pine or cedar wood. The wood panel members are tongue and grooved, top and bottom, respectively, as indicated at 60 and 62 in FIG. 4, and secured together with 8 inch ardox nails 64 driven through one panel member and into the bottom of the panel member thereabove. The uppermost member need not be tongued and the lowermost member need not be grooved. The wood panel members 61 also have vertically extending grooves 63 in their ends which are in alignment with groove 25 of each mullion. Wood splines 67 preferably made of solid cedar wood extend in the second grooves 25 of the mullions and grooves 63 of panel members 61 with sealing material, caulking or an adhesive type polyurethane sealant, therefor. The top and bottom edges of the spline are generally flush with the top of the mullions and the shoulders of the mullion, respectively. With the wood spines securely in place, members 61 are secured in place in a manner similar to the securement of slabs 51, i.e., 30d galvanized nails 65 are driven through each mullion from its second side face 17 and into the side of each member 61. The prefabricated panel may now be easily installed in position by placing shoulder 35 flat on subfloor 9 and the vertical face 33 flush against the boxing 7 with the bottom of the panel against logs 11.

Although not shown in the drawings, it will be understood that a series of panels 1 may be secured together, side by side, by applying caulk or an adhesive type polyurethane sealant inside groove 27 of each panel and securing a wood spline in grooves 27 of the adjoining panels. The joined panels are then placed on a right angle steel plate 69 secured to the subfloor 9. 8d nails are then driven through the vertical leg 71 of the sill plate 69 into the mullions and bottom members of the panels thus locking the panels together and anchoring them to the floor.

All of the wood components of the log wall panels preferably are kiln-dried in order to eliminate any splitting or checking of the wood.

It will be observed from the foregoing the above-described prefabricated panel is simple in construction and easy to install.

In view of the above, it will be seen that the several objects of the invention are achieved and other advantages results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A prefabricated panel for a post and sill panelized log wall system comprising vertical mullions constituting the sides of the panel, each mullion comprising a wooden member of generally rectangular cross section having generally parallel first and second side faces and inside and outside faces, first side faces facing each other, each mullion having a first groove extending lengthwise thereof in said first side face, a second groove extending lengthwise thereof in said first side face between the first groove and the inside face of the panel, and a third groove extending lengthwise thereof in the second side face thereof, each mullion having a recess at its lower end extending up from its lower end and extending toward the outside from its inside face providing a vertical face facing toward the inside and an upper shoulder extending from its inside face to said vertical face, said vertical face being generally coplanar with the edges of said first grooves toward the outside of the mullions;

a rigid insulation panel extending between the mullions having its ends sealed and adhered in said first grooves, said insulation panel extending from the top of said prefabricated panel down to and terminating at the level of said shoulders;

a layer of nail hole plugging material on the outside of said insulation panel between said first side faces of the mullions;

a series of wood log slabs, one above another, on the outside of said layer of material extending between said first side faces of the mullions;

a series of elongate wood panel members, one above another, on the inside of the insulation panel, extending between said first side faces of the mullions, said wood panel members being tongue and grooved top and bottom, said wood panel members having vertically extending grooves in their ends; and wood splines extending in the said second grooves of the mullions and the grooves in the ends of the wood inside panel members with sealing material therefor, the top edge of the upper most wood panel member being generally flush with the top of the mullions and the bottom edge of the lowermost wood panel member being generally flush with said shoulders.

2. A prefabricated panel for a post and sill panelized log wall system as set forth in claim 1 wherein said first groove extends generally centrally of said first side face.

3. A prefabricated panel for a post and sill panelized log wall system as set forth in claim 1 wherein said third groove extends generally centrally of said second side face.

* * * * *